US008472827B2

(12) United States Patent
Hase

(10) Patent No.: US 8,472,827 B2
(45) Date of Patent: Jun. 25, 2013

(54) FIXING DEVICE, IMAGE FORMING APPARATUS INCLUDING SAME, AND FIXING METHOD

(75) Inventor: Takamasa Hase, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 633 days.

(21) Appl. No.: 12/552,654

(22) Filed: Sep. 2, 2009

(65) Prior Publication Data

US 2010/0061753 A1 Mar. 11, 2010

(30) Foreign Application Priority Data

Sep. 9, 2008 (JP) ..... 2008-230527

(51) Int. Cl.
*G03G 15/20* (2006.01)

(52) U.S. Cl.
USPC ..... 399/69; 399/328

(58) Field of Classification Search
USPC ..... 399/67, 69, 328, 329
See application file for complete search history.

(56) References Cited

U.S. PATENT DOCUMENTS

| | | | | |
|---|---|---|---|---|
| 6,047,158 | A | 4/2000 | Morigami et al. | |
| 2002/0146254 | A1* | 10/2002 | Richtsmeier | 399/68 |
| 2003/0091360 | A1 | 5/2003 | Onodera et al. | |
| 2006/0147221 | A1* | 7/2006 | Asakura et al. | 399/69 |
| 2007/0274748 | A1 | 11/2007 | Yoshikawa | |
| 2009/0060550 | A1* | 3/2009 | Seo | 399/69 |
| 2009/0148205 | A1 | 6/2009 | Seo et al. | |

FOREIGN PATENT DOCUMENTS

| | | |
|---|---|---|
| JP | 2001-043965 A | 2/2001 |
| JP | 2002-23557 | 1/2002 |
| JP | 2005-321642 | 11/2005 |
| JP | 2007-047390 A | 2/2007 |
| JP | 2007-114669 A | 5/2007 |
| JP | 2007-226126 | 9/2007 |
| JP | 2008-40176 | 2/2008 |
| JP | 2008-139472 | 6/2008 |
| JP | 2008-185991 | 8/2008 |

OTHER PUBLICATIONS

U.S. Appl. No. 12/408,318, filed Mar. 20, 2009, Hiroshi Seo et al.
U.S. Appl. No. 12/457,043, filed May 29, 2009.
Japanese Office Action issued Dec. 27, 2012 in Japanese Application No. 2008-230527 filed Sep. 9, 2008.

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A fixing device including a fixing member to melt a toner image to fix the toner image to a recording medium, a pressing member pressed against the fixing member to form a nip to where the recording medium is conveyed, multiple temperature detectors to detect a temperature at multiple positions on a surface of the pressing member in a width direction thereof, a heating member including a heating layer to heat the fixing member; an exciting coil to generate magnetic fluxes to inductively heat the heating layer, and one or more pairs of degaussing coils to generate magnetic fluxes to degauss the magnetic fluxes generated by the exciting coil. An amount of power supplied to the one or more pairs of degaussing coils is controlled based on a result detected by each of the multiple temperature detectors.

23 Claims, 6 Drawing Sheets

FIXING DEVICE, IMAGE FORMING APPARATUS INCLUDING SAME, AND FIXING METHOD

CROSS-REFERENCE TO RELATED APPLICATIONS

The present patent application is based on and claims priority pursuant to 35 U.S.C. §119 from Japanese Patent Application No. 2008-230527, filed on Sep. 9, 2008 in the Japan Patent Office, the entire contents of which are incorporated herein by reference.

BACKGROUND OF THE INVENTION

1. Field of the Invention

Exemplary aspects of the present invention generally relate to a fixing device, an image forming apparatus including the fixing device, and a fixing method employed in the fixing device, and particularly to a fixing device employing an electromagnetic induction heating method using degaussing coils, and an image forming apparatus including the fixing device.

2. Description of the Background

Related-art image forming apparatuses, such as copiers, facsimile machines, printers, or multifunction devices having two or more of copying, printing, scanning, and facsimile functions, typically form a toner image on a recording medium (e.g., a sheet) according to image data using an electrophotographic method. In such a method, for example, a charger charges a surface of a latent image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

One example of the fixing device included in the related-art image forming apparatuses employs an electromagnetic induction heating method in which degaussing coils are provided to prevent an excessive increase in temperature in a non-conveyance portion of a heating member not covered by a sheet.

For example, a fixing device including an induction heating unit provided with an exciting coil and multiple pairs of degaussing coils positioned opposite the exciting coil at both edges of the induction heating unit in a width direction thereof has been proposed. Specifically, the multiple pairs of the degaussing coils are provided at positions corresponding to respective non-conveyance portions of a heating member not covered by each type of sheets having a different size. The multiple pairs of the degaussing coils degauss magnetic fluxes from the exciting coil generated at the position opposite the multiple pairs of the degaussing coils. As a result, an excessive increase in temperature at the non-conveyance portions of the heating member is prevented.

In another approach, Published Unexamined Japanese Patent Application No. 2005-321642 (hereinafter referred to as JP-2005-321642-A) discloses a technique in which a temperature sensor (or a contact-type thermistor) that detects a temperature at an edge of a fixing member in a width direction thereof corresponding to a position of a degaussing coil is provided to drive the degaussing coil based on an increase in the temperature detected by the temperature sensor.

In yet another approach, Published Unexamined Japanese Patent Application No. 2007-226126 (hereinafter referred to as JP-2007-226126-A) discloses a technique in which a temperature sensor that detects a temperature at an edge of a pressing member in a width direction thereof corresponding to a position of each of multiple degaussing coils is provided to control an amount of power supplied to the degaussing coils based on the temperature at a non-conveyance portion of the pressing member detected by the temperature sensor.

However, both the number of types of the above-described temperature sensor for controlling an amount of power supplied to the degaussing coil and positions to install the above-described temperature sensors are considerably limited.

Specifically, in the case of the technique disclosed in JP-2005-321642-A in which the contact-type thermistor is provided to detect a temperature at the edge of the fixing member in a width direction thereof, a mark generated when the contact-type thermistor contacts a surface of the fixing member remains on the surface of the fixing member, and that mark appears also on an image fixed to a sheet. Consequently, an expensive contactless temperature sensor such as a thermopile is required to solve the above-described problem.

Further, because a larger number of components including an exciting coil, the degaussing coil, a separation plate, and so forth are densely packed around the fixing member, it is difficult to spare enough space to provide the temperature sensor to detect the temperature at the edge of the fixing member in the width direction thereof.

By contrast, in the case of the technique disclosed in JP-2007-226126-A, as described above, the temperature sensor that detects a temperature at the edge of the pressing member in the width direction thereof corresponding to the position of each of the degaussing coils is provided to control an amount of power supplied to the degaussing coils based on the temperature at the non-conveyance portion of the pressing member detected by the temperature sensor. Accordingly, the problem of JP-2005-321642-A may be solved.

However, because a difference in a temperature between the fixing member and the pressing member is not always kept constant, it is difficult to control the amount of power supplied to the degaussing coils by indirectly detecting an increase in temperature at the non-conveyance portion of the fixing member based on the result detected by the single temperature sensor provided at the edge of the pressing member in the width direction thereof. In other words, an increase in temperature at the non-conveyance portion of the fixing member may fail to be detected accurately, allowing an excessive increase in temperature in the non-conveyance portion of the fixing member and a decrease in temperature at an edge of a conveyance portion of the fixing member covered by the sheet.

SUMMARY

In view of the foregoing, illustrative embodiments of the present invention provide a fixing device that achieves a higher degree of flexibility in types and installation positions of a temperature detector provided therein to control an amount of power supplied to degaussing coils, and efficiently and reliably prevents an excessive increase in temperature at a non-conveyance portion of a fixing member using the degaussing coils. Illustrative embodiments of the present invention further provide an image forming apparatus including the fixing device, and a fixing method employed in the fixing device.

In one illustrative embodiment, a fixing device includes a fixing member to melt a toner image to fix the toner image to a recording medium, a pressing member pressed against the fixing member to form a nip to where the recording medium is conveyed, multiple temperature detectors to detect a temperature at multiple positions on a surface of the pressing member in a width direction thereof, a heating member including a heating layer to heat the fixing member, an exciting coil provided opposite the heating member to generate magnetic fluxes to inductively heat the heating layer using the magnetic fluxes, and one or more pairs of degaussing coils provided opposite the exciting coil at both edges of the fixing member in a width direction thereof to generate magnetic fluxes at both edges of the fixing member to degauss the magnetic fluxes generated by the exciting coil. An amount of power supplied to the one or more pairs of degaussing coils is controlled based on a result detected by each of the multiple temperature detectors.

Another illustrative embodiment provides an image forming apparatus including the fixing device as described above.

Yet another illustrative embodiment provides a fixing method including the steps of melting a toner image to fix the toner image to a recording medium, forming a nip between a fixing member and a pressing member to where the recording medium is conveyed, detecting a temperature at multiple positions on a surface of the pressing member in a width direction thereof using multiple temperature detectors, heating a heating member to heat the fixing member, generating first magnetic fluxes to inductively heat the heating member, and generating second magnetic fluxes at both edges of the fixing member to degauss the first magnetic fluxes. An amount of power supplied for generating the second magnetic fluxes at both edges of the fixing member is controlled based on detection readings provided by the multiple temperature detectors.

Additional features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
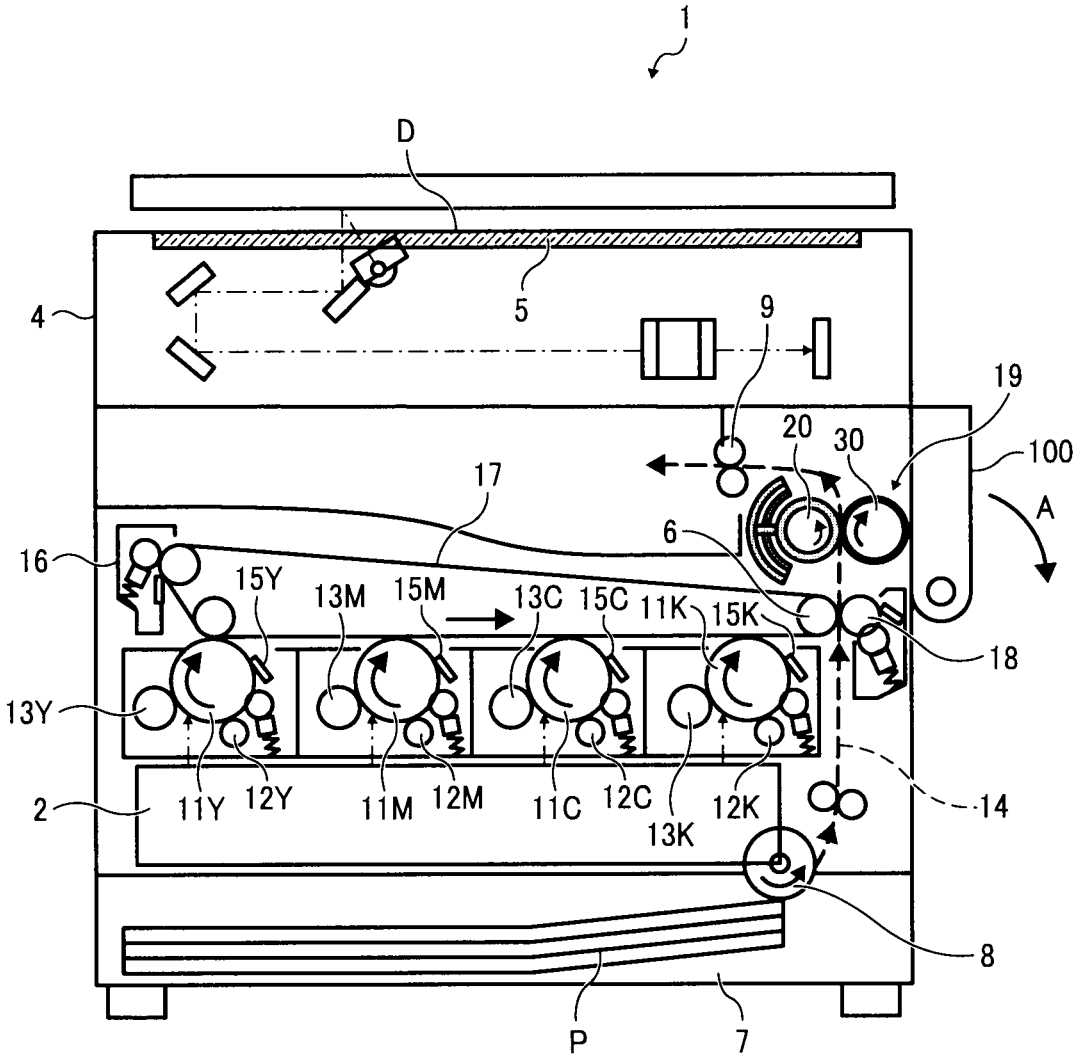
FIG. 1 is a schematic view illustrating an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration and operations of an image forming apparatus according to illustrative embodiments with reference to FIG. 1. FIG. 1 is a schematic view illustrating a tandem-type full-color copier serving as an image forming apparatus 1 according to illustrative embodiments. Referring to FIG. 1, the image forming apparatus 1 includes a writing unit 2 to emit laser light based on input image data; a reading unit 4 to read image data of a document D; a sheet feeder 7 to store a recording medium such as a transfer sheet (hereinafter referred to as a sheet P); photoconductors 11Y, 11M, 11C, and 11K (hereinafter collectively referred to as photoconductors 11) each forming a toner image of either yellow, magenta, cyan, or black; chargers 12Y, 12M, 12C, and 12K (hereinafter referred to as chargers 12) to charge the respective photoconductors 11, developing devices 13Y, 13M, 13C, and 13K (hereinafter collectively referred to as developing devices 13) to develop electrostatic latent images formed on the respective photoconductors 11, and cleaning devices 15Y, 15M, 15C, and 15K (hereinafter collectively referred to as cleaning devices 15) to collect residual toner particles on the respective photoconductors 11.

The image forming apparatus 1 further includes an intermediate transfer belt 17 onto which multiple toner images are sequentially transferred in a superimposed manner, a belt cleaning unit 16 to clean the intermediate transfer belt 17, a secondary transfer roller 18 to transfer a full-color toner image formed on the intermediate transfer belt 17 onto the sheet P, and a fixing device 19 employing an electromagnetic induction heating method to fix the full-color toner image to the sheet P.

A description is now given of full-color image formation performed by the image forming apparatus 1.

Image data of the document D placed on a contact glass 5 is optically read by the reading unit 4. Specifically, the reading unit 4 causes light emitted from an illumination lamp provided therein to the document D placed on the contact glass 5 to scan on the document D. The light reflected from the document D is collected to a color sensor through a group of mirrors and lenses respectively provided in the reading unit 4. Subsequently, color image data of the document D is read for each separated color light of red, green, or blue by a color sensor, and converted into an electric image signal. Further, color conversion, color collection, special frequency collection, and so forth are performed by an image processing unit based on a separated color image signal of red, green, or blue to obtain color image data of yellow, magenta, cyan, or black. The color image data of yellow, magenta, cyan, or black is sent to the writing unit 2, and laser light based on the color image data of each color is emitted to the respective photoconductors 11 from the writing unit 2.

Each of the photoconductors 11 is rotated in a clockwise direction in FIG. 1. The chargers 12 evenly charge surfaces of the respective photoconductors 11 at a position opposite the photoconductors 11 to provide charging potentials to the surfaces of the photoconductors 11. Thereafter, each of the surfaces of the photoconductors 11 thus evenly charged reaches a position to where the laser light emitted from the writing unit 2 is directed.

The reading unit 2 directs the laser light corresponding to each of the image signals emitted from each of four light sources to the respective photoconductors 11. Each of the laser light passes a different light path for each color component of yellow, magenta, cyan, or black.

For example, the laser light corresponding to a yellow complement is directed to the surface of the photoconductor 11Y positioned at the leftmost position in FIG. 1. At this time, the laser light corresponding to the yellow component is scanned in a direction of a rotation axis of the photoconductor 11Y, that is, a main scanning direction, by a polygon mirror rotated at high speed. Accordingly, an electrostatic latent image corresponding to the yellow component is formed on the surface of the photoconductor 11Y evenly charged by the charger 12Y.

In the same way as described above, the laser light corresponding to a magenta component is directed to the surface of the photoconductor 11M, which is the second photoconductor from the left in FIG. 1, to form an electrostatic latent image corresponding to the magenta component on the surface of the photoconductor 11M. The laser light corresponding to a cyan component is directed to the surface of the photoconductor 11C, which is the third photoconductor from the left in FIG. 1, to form an electrostatic latent image corresponding to the cyan component on the surface of the photoconductor 11C. The laser light corresponding to a black component is directed to the surface of the photoconductor 11K, which is the fourth photoconductor from the left in FIG. 1, to form an electrostatic latent image corresponding to the black component on the surface of the photoconductor 11K.

Thereafter, the surfaces of the photoconductors 11 having the electrostatic latent images of the specific colors thereon reach a position facing the developing devices 13, respectively. At this position, toner of either yellow, magenta, cyan, or black is supplied to the electrostatic latent images formed on the surfaces of the photoconductors 11 from the developing devices 13, respectively. As a result, toner images of yellow, magenta, cyan, or black are formed on the surfaces of the photoconductors 11, respectively.

Thereafter, the surfaces of the photoconductors 11 each having the toner images of the respective colors thereon reach positions facing the intermediate transfer belt 17, respectively. A transfer bias roller, not shown, is provided at each position where the photoconductors 11 face the intermediate transfer belt 17 to contact an inner surface of the intermediate transfer belt 17. The toner images of the respective colors formed on the surfaces of the photoconductors 11 are sequentially transferred onto the intermediate transfer belt 17 in a superimposed manner by the transfer bias rollers, respectively, so that a full-color toner image is formed on the intermediate transfer belt 17.

After the toner images are transferred onto the intermediate transfer belt 17, the surfaces of the photoconductors 11 reach the cleaning devices 15, respectively. The cleaning devices 15 collect residual toner particles on the surfaces of the photoconductors 11, respectively.

Thereafter, the surfaces of the photoconductors 11 pass neutralizing devices, not shown, respectively, and a series of image forming processes performed by the photoconductors 11 is completed.

Meanwhile, the toner images sequentially transferred onto the intermediate transfer belt 17 in a superimposed manner, that is, the full-color toner image formed on the intermediate transfer belt 17, reaches the secondary transfer roller 18. At this position, the intermediate transfer belt 17 is sandwiched between the secondary transfer roller 18 and a secondary transfer backup roller 6 to form a secondary transfer nip. The full-color toner image formed on the intermediate transfer belt 17 is secondarily transferred onto the sheet P conveyed to the secondary transfer nip. Toner particles that are not secondarily transferred onto the sheet P remain on the intermediate transfer belt 17 as residual toner particles.

Thereafter, the intermediate transfer belt 17 reaches the belt cleaning unit 16. The belt cleaning unit 16 collects the residual toner particles from the intermediate transfer belt 17, and a series of transfer processes performed on the intermediate transfer belt 17 is completed.

The sheet P is conveyed to the secondary transfer nip from the sheet feeder 7 provided at a bottom portion of the image forming apparatus 1 through a conveyance path 14 along which a sheet feed roller 8, a pair of registration rollers, not shown, and so forth are provided.

Specifically, a stack of multiple sheets P is stored in the paper feeder 7. When the sheet feed roller 8 is rotated in a counterclockwise direction in FIG. 1, the sheet P placed at the top of the stack of the multiple sheets P is fed to the conveyance path 14.

The sheet P fed to the conveyance path 14 is temporarily stopped at a nip formed between the pair of the registration rollers, each of which is not rotated. Thereafter, the pair of the registration rollers is rotated in synchronization with the full-color toner image on the intermediate transfer belt 17 so that the sheet P is conveyed to the secondary transfer nip. Accordingly, the full-color toner image is secondarily transferred onto the sheet P.

The sheet P having the transferred full-color toner image thereon is conveyed to the fixing device 19. In the fixing device 19, heat and pressure are applied to the sheet P from a fixing roller 20 and a pressing roller 30, respectively, so that the full-color toner image is fixed to a surface of the sheet P.

Thereafter, the sheet P having the fixed full-color toner image thereon is discharged from the image forming apparatus 1 in a direction indicated by a broken-line arrow in FIG. 1 by a discharge roller 9, and a series of image forming processes performed by the image forming apparatus 1 is completed.

Figure 2:
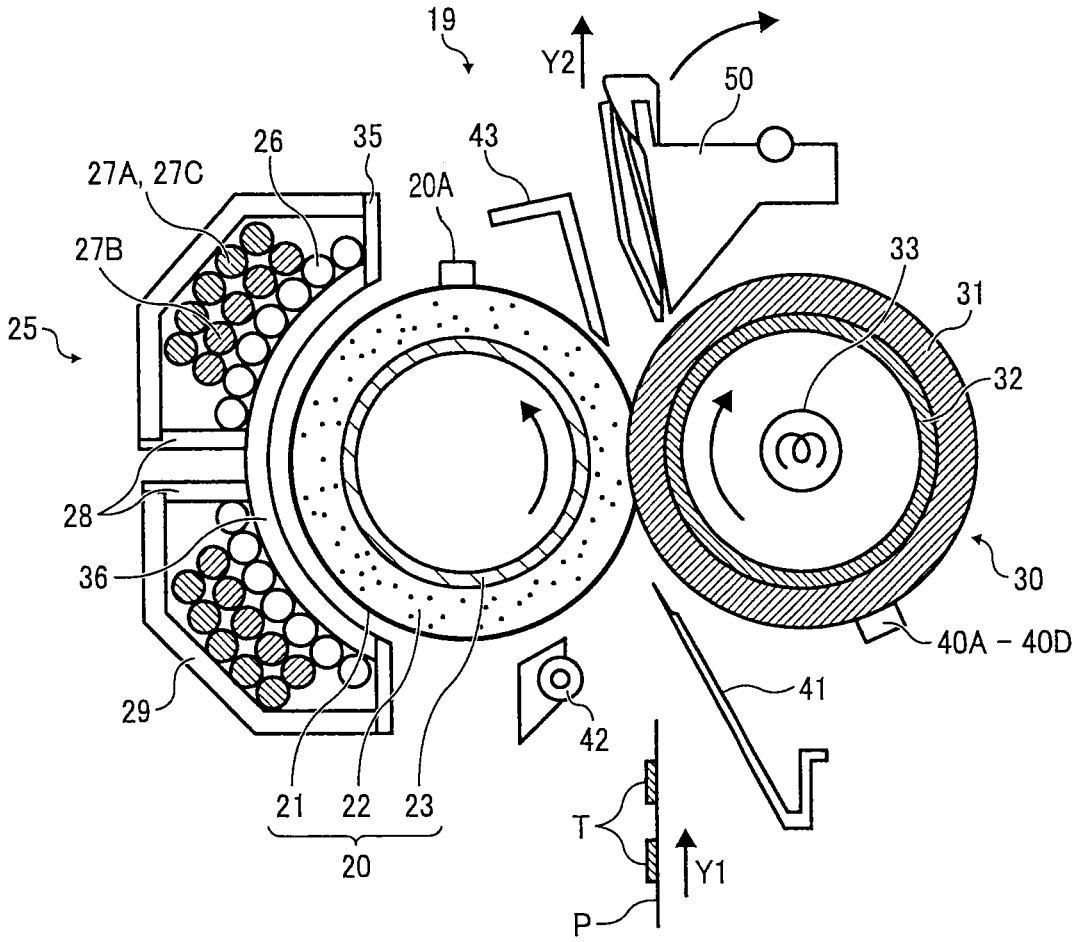
FIG. 2 is a schematic view illustrating a fixing device included in the image forming apparatus illustrated in FIG. 1.

A description is now given of a configuration and operations of the fixing device 19 included in the image forming apparatus 1. FIG. 2 is a schematic view illustrating the fixing device 19 according to illustrative embodiments.

Referring to FIG. 2, the fixing device 19 includes an induction heating unit 25 serving as magnetic flux generation means, the fixing roller 20 serving as a heating member provided opposite the induction heating unit 25, the pressing roller 30 serving as a pressing member pressed against the fixing roller 20, first to fourth thermistors 40A to 40D each serving as a temperature detector, an entrance guide plate 41, multiple spurs 42, a separation plate 43, a guide member 50, and so forth.

The fixing roller 20 includes a metal core 23 made of iron, stainless steel, and so forth; a heat insulating elastic layer 22 made of silicone rubber foam and so forth; and a sleeve layer 21. The heat insulating elastic layer 22 and the sleeve layer 21 are sequentially superimposed on the metal core 23 to form the fixing roller 20, which has an outer diameter of about 40 mm.

The sleeve layer 21 of the fixing roller 20 has a multi-layered structure in which a substrate layer, a first antioxidant layer, a heating layer, a second antioxidant layer, an elastic layer, and a release layer are sequentially superimposed one atop another, in that order, from an inner circumferential surface of the sleeve layer 21 outward. Specifically, the substrate layer is formed of stainless steel having a thickness of about 40 μm. Each of the first and second antioxidant layers is formed of strike plated nickel having a thickness of 1 μm or less. The heating layer is formed of copper having a thickness of about 10 μm. The elastic layer is formed of silicone rubber having a thickness of about 150 μm. The release layer is formed of PFA (Tetra fluoro ethylene-perfluoro alkylvinyl ether copolymer) having a thickness of about 30 μm.

In the fixing roller 20 having the above-described structure, the heating layer in the sleeve layer 21 is inductively heated by magnetic fluxes generated by an exciting coil 26 included in the induction heating unit 25.

It is to be noted that the structure of the fixing roller 20 is not limited to the above-described example. Alternatively, for example, the sleeve layer 21 may be independently provided without being bonded to the heat insulating elastic layer 22. However, in a case in which the sleeve layer 21 is independently provided without being bonded to the heat insulating elastic layer 22, it is required to provide a member to prevent the sleeve layer 21 from moving in a width direction of the fixing roller 20, that is, a thrust direction, while the fixing roller 20 is rotated.

The multiple spurs 42 are arranged side by side in a width direction of the fixing device 19 at positions opposite the fixing roller 20 on an upstream side from a nip formed between the fixing roller 20 and the pressing roller 30 (hereinafter referred to as a fixing nip) relative to a direction of conveyance of the sheet P. The multiple spurs 42 are provided to guide the sheet P to the fixing nip. A circumferential surface of each of the multiple spurs 42 has a sawtooth shape thereon to prevent scraping an unfixed full-color toner image transferred onto the sheet P even when the multiple spurs 42 contact the unfixed full-color toner image.

The separation plate 43 is provide at a position opposite the fixing roller 20 on a downstream side from the fixing nip relative to the direction of conveyance of the sheet P. The separation plate 43 prevents the sheet P having a fixed full-color image thereon conveyed from the fixing nip from attaching to the fixing roller 20. Specifically, when the sheet P onto which the full-color image is fixed is attracted to the fixing roller 20 after being conveyed from the fixing nip, the separation plate 43 contacts a leading edge of the sheet P to separate the sheet P from the fixing roller 20.

A thermopile 20A is provided at a position opposite a center on a surface of the fixing roller 20 in the width direction thereof. A temperature, that is, a fixing temperature, on the fixing roller 20 is detected by the thermopile 20A in a contactless manner. An amount of heat supplied from the induction heating unit 25 is adjusted based on a result detected by the thermopile 20A.

The pressing roller 30 includes a cylinder member 32 formed of aluminum, copper, and so forth; an elastic layer 31 formed of silicone rubber and so forth, and a release layer, not shown, formed of PFA and so forth. Specifically, the elastic layer 31 and the release layer are superimposed on the cylinder member 32 to form the pressing roller 30. A thickness of the elastic layer 31 is from 1 to 5 mm, and that of the release layer is from 20 to 50 μm. As described above, the pressing roller 30 is pressed against the fixing roller 20, and the sheet P having the unfixed full-color toner image thereon is conveyed to the fixing nip formed between the fixing roller 20 and the pressing roller 30.

The pressing roller 30 includes a heater 33 such as a halogen heater to more efficiently heat the fixing roller 20. Power is supplied to the heater 33 so that the pressing roller 30 is heated by radiation heat from the heater 33, and the surface of the fixing roller 20 is heated via the pressing roller 30. An amount of heat from the heater 33 is adjusted by a result detected by the first thermistor 40A contacting a center on a surface of the pressing roller 30 in the width direction thereof.

The first thermistor 40A, the second thermistor 40B, the third thermistor 40C, and the fourth thermistor 40D each serving as a contact-type temperature detector to detect a temperature on the surface of the pressing roller 30 at multiple positions in the width direction of the pressing roller 30 are provided contacting the surface of the pressing roller 30, respectively. Specifically, the first thermistor 40A serves as a first temperature detector unit to detect a temperature at the center on the surface of the pressing roller 30 in the width direction thereof. Each of the second, third and fourth thermistors 40B, 40C, and 40D serves as a second temperature detector unit to detect a temperature at an edge on the surface of the pressing roller 30 in the width direction thereof corresponding to a position of a counterpart of each pair of degaussing coils 27A, 27B, and 27C in the width direction. An amount of power supplied to each of the multiple pairs of the degaussing coils 27A, 27B, and 27C is controlled based on results detected by the multiple thermistors 40A to 40D. Control of the multiple pairs of the degaussing coils 27A, 27B, and 27C is to be described in detail later.

The entrance guide plate 41 is provided at a position opposite the pressing roller 30 on an upstream side from the fixing nip relative to the direction of conveyance of the sheet P. The entrance guide plate 41 guides the sheet P to the fixing nip.

The guide member 50 is provided at a position opposite the pressing roller 30 on a downstream side from the fixing nip relative to the direction of conveyance of the sheet P, that is, a position opposite a back side of the sheet P to which fixing processes are not performed. The guide member 50 guides the sheet P having the fixed full-color image thereon conveyed from the fixing nip to a conveyance path after the fixing processes.

The induction heating unit 25 includes the exciting coil 26, the first pair of the degaussing coils 27A, the second pair of the degaussing coils 27B, the third pair of the degaussing coils 27C, multiple center cores 28, multiple arch cores 29, two side cores 35, a coil guide 36, and so forth.

The induction heating unit 25 is detachably attachable to a main part of the fixing device 19. The main part of the fixing device 19 is detached from the induction heating unit 25 and removed from the image forming apparatus 1 through a door 100 opened in a rightward direction as indicated by an arrow A in FIG. 1.

The exciting coil 26 includes a wound litz wire including a bundle of thin wires extended in a width direction of the induction heating unit 25, that is, a direction perpendicular to a plane surface of FIG. 2, on the coil guide 36 provided to cover a part of an outer circumferential surface of the fixing roller 20 having the heating layer therein. The exciting coil 26 is provided opposite the fixing roller 20, and generates magnetic fluxes to inductively heat the heating layer in the sleeve layer 21 of the fixing roller 20.

The multiple pairs of the degaussing coils 27A, 27B, and 27C are provided opposite the exciting coil 26 at both edges of the induction heating unit 25 in the width direction thereof. Each of the multiple pairs of the degaussing coils 27A, 27B, and 27C generates a magnetic flux at both edges of the induction heating unit 25 in the width direction thereof to degauss the magnetic fluxes generated by the exciting coil 26.

Figure 3A:
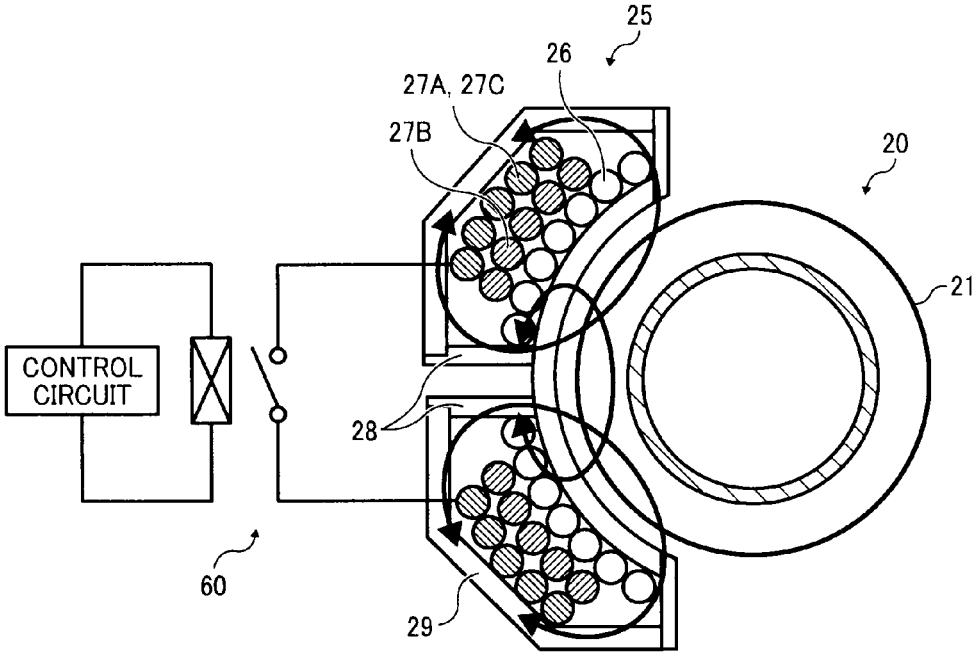
FIGS. 3A and 3B are views respectively illustrating generation of magnetic fluxes from an induction heating unit included in the fixing device illustrated in FIG. 2.

Specifically, referring to FIG. 3A, when a changeover switch of a switching circuit 60 is opened, that is, when the multiple pairs of the degaussing coils 27A, 27B, and 27C are not operated, the magnetic fluxes generated by the exciting coil 26 indicated by bold arrows in FIG. 3A form a magnetic circuit passing through the heating layer in the sleeve layer 21 of the fixing roller 20. As a result, an induction current flows into the heating layer, and Joule heat causes the heating layer to generate heat.

Figure 3B:
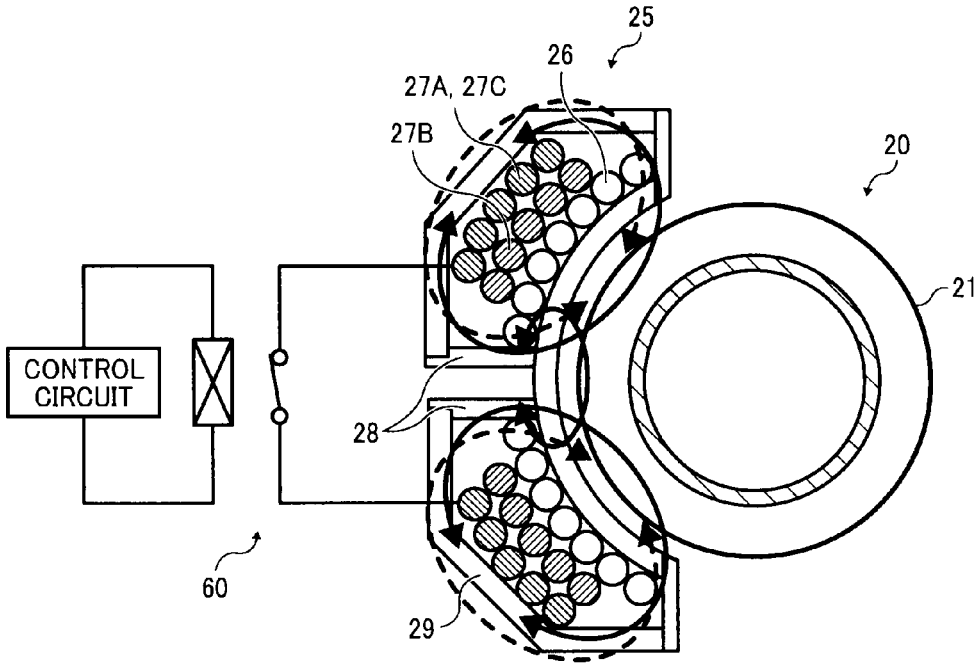

By contrast, referring to FIG. 3B, when the changeover switch of the switching circuit 60 is closed, that is, when a part or all of the multiple pairs of the degaussing coils 27A, 27B, and 27C is or are operated, the magnetic fluxes generated by the exciting coil 26 indicated by bold arrows in FIG. 3B are degaussed by the magnetic fluxes generated by a part or all of the multiple pairs of the degaussing coils 27A, 27B, and 27C indicated by bold broken arrows in FIG. 3B and turns in very weak magnetic fluxes. Accordingly, the magnetic fluxes that heat the heating layer in the sleeve layer 21 of the fixing roller 20 are considerably weakened, and an amount of heat supplied to the fixing roller 20 can be reduced at the positions opposite the multiple pairs of the degaussing coils 27A, 27B, and 27C, that is, both edges of the induction heating unit 25 in the width direction thereof.

Although not shown, the switching circuit 60 is independently provided for each pair of the multiple degaussing coils 27A, 27B, and 27C. A proportion of time to turn on and off power supply to each of the three pairs of the degaussing coils 27A, 27B, and 27C for a predetermined frequency, that is, a duty cycle (%) of each of the three pairs of the degaussing coils 27A, 27B, and 27C, is varied by the switching circuit 60 to control an amount of power supplied to each of the multiple pairs of the degaussing coils 27A, 27B, and 27C.

Figure 4A:
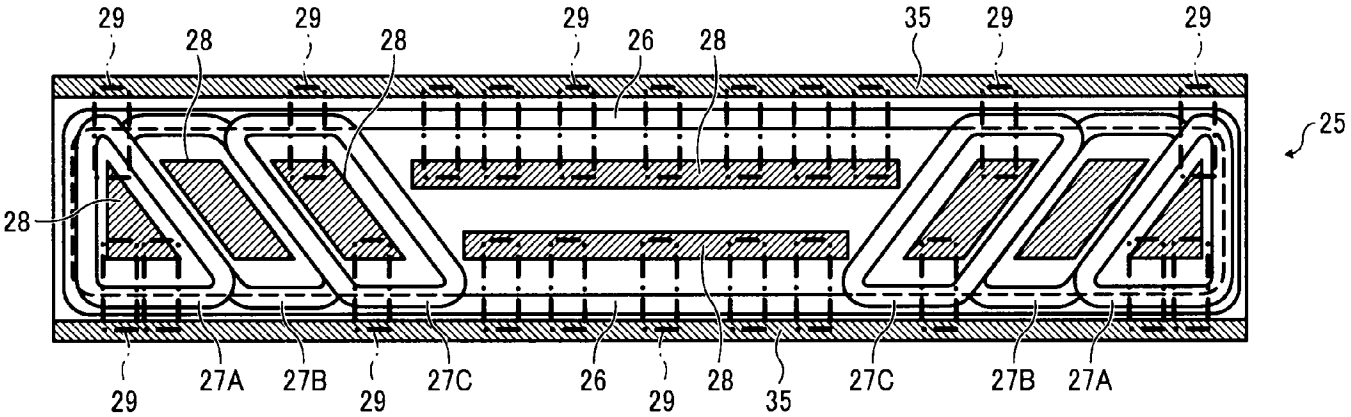
FIGS. 4A, 4B, and 4C are views respectively illustrating relative positions of each of pairs of degaussing coils and thermistors.
Figure 4B:
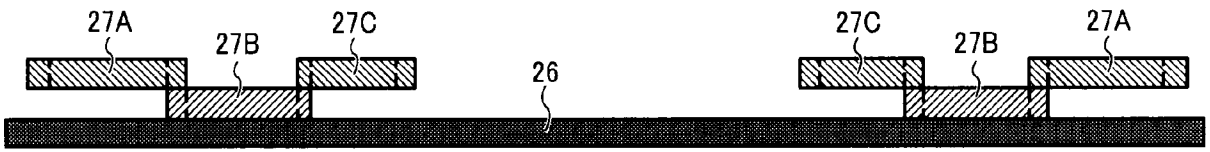
Figure 4C:
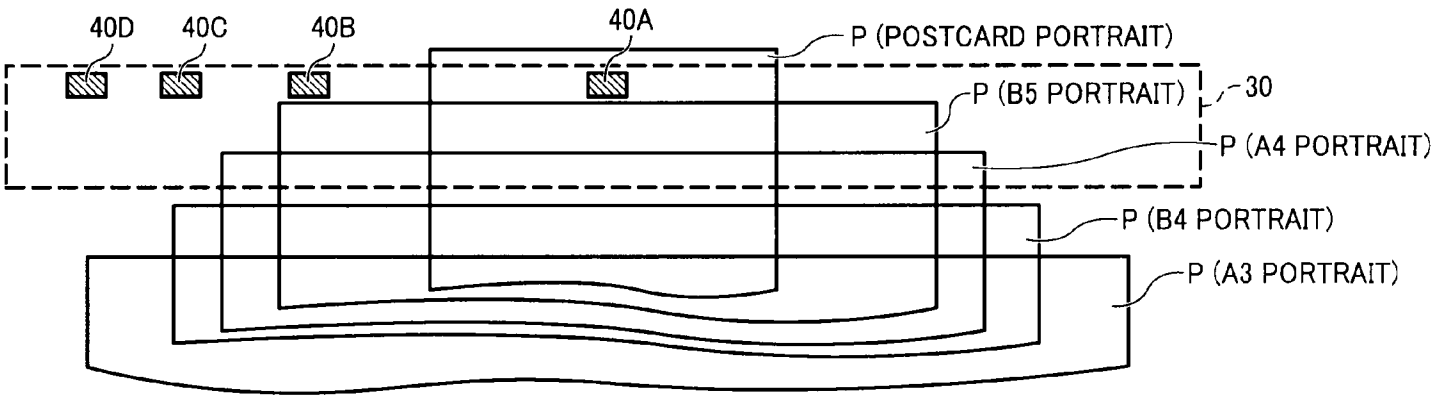

FIGS. 4A to 4C are views respectively illustrating relative positions of each of the pairs of the degaussing coils 27A, 27B, and 27C, and the first to fourth thermistors 40A to 40D. Referring to FIGS. 4A to 4C, according to illustrative embodiments, the first pair of the degaussing coils 27A, the second pair of the degaussing coils 27B, and the third pair of the degaussing coils 27C are arranged side by side in the induction heating unit 25 in the width direction thereof, that is, a horizontal direction in FIGS. 4A to 4C, corresponding to a size of the sheet P including a B4 size, an A4 size or a B5 size, and a postcard size. A portion of the heating layer in the sleeve layer 21 of the fixing roller 20 in the width direction thereof heated by the induction heating unit 25 is changed by the three pairs of the degaussing coils 27A, 27B, and 27C depending on a portion on the surface of the fixing roller 20 covered by multiple types of the sheet P each having a different size (hereinafter referred to as a conveyance portion of the fixing roller 20).

Specifically, when the sheet P having an A3 size is conveyed in portrait orientation to the fixing nip, the changeover switch of each of the three pairs of the degaussing coils 27A, 27B, and 27C is opened. When the sheet P having a B4 size is conveyed in portrait orientation to the fixing nip, only the changeover switch of the first pair of the degaussing coils 27A is closed. When the sheet P having an A4 size is conveyed in portrait orientation to the fixing nip, the changeover switch for each of the first and second pairs of the degaussing coils 27A and 27B is closed. When the sheet P having a postcard size is conveyed in portrait orientation to the fixing nip, the changeover switches for all three pairs of the degaussing coils 27A, 27B, and 27C are closed.

Because there is only a slight difference in size between the B5 size and the A4 size, according to illustrative embodiments, when the sheet P having the B5 size is conveyed in portrait orientation to the fixing nip, the changeover switches for the first and second pairs of the degaussing coils 27A and 27B are closed, respectively, in the same manner as when the sheet P having the A4 size is conveyed in portrait orientation to the fixing nip. In other words, the same pairs of degaussing coils, that is, the first and second pairs of the degaussing coils 27A and 27B, are operated when the sheet P having either the A4 size or the B5 size is conveyed in portrait orientation to the fixing nip. Alternatively, another pair of degaussing coils for the sheet P having the B5 size may be additionally provided.

As described above, power supply to each of the three pairs of the degaussing coils 27A, 27B, and 27C is controlled based on the size of the sheet P conveyed to the fixing nip. The size of the sheet P is indirectly determined by detecting a temperature distribution on the surface of the pressing roller 30 in the width direction thereof.

Specifically, each of the first to fourth thermistors 40A to 40D is provided at a position opposite the surface of the pressing roller 30 in the width direction thereof in a contact manner corresponding to an edge of each type of the sheet P having a different size. More specifically, the first thermistor 40A is provided opposite the center on the surface of the pressing roller 30 in the width direction thereof, and each of the second to fourth thermistors 40B and 40D is provided at a position opposite the surface of the pressing roller 30 in the width direction thereof corresponding to each of the first to third pairs of the degaussing coils 27A to 27C. A temperature distribution on the surface of the pressing roller 30 in the width direction thereof is thus detected by the four thermistors 40A to 40D. In other words, a temperature distribution on the surface of the fixing roller 20 in the width direction thereof is indirectly detected by the four thermistors 40A to 40D. A temperature on the surface of the pressing roller 30 decreases at a portion covered by the sheet P (hereinafter referred to as a conveyance portion of the pressing roller 30) because the sheet P and the fixing roller 20 absorb heat from the pressing roller 30 at the conveyance portion. By contrast, the temperature of the pressing roller 30 remains relatively high at a portion not covered by the sheet P (hereinafter referred to as a non-conveyance portion of the pressing roller 30) compared to the conveyance portion of the pressing roller 30. Accordingly, the size of the sheet P conveyed to the fixing nip can be determined by detecting the temperature distribution on the surface of the pressing roller 30 in the width direction thereof. Which pairs of the degaussing coils 27A, 27B, or 27C are supplied with power, and in what amounts, are determined based on the temperature distribution on the surface of the pressing roller 30 thus detected.

As described above, instead of providing a contact-type thermistor to the fixing roller 20, the contact-type thermistors 40A to 40D are provided opposite the surface of the pressing roller 30 to control the power supply to the multiple pairs of the degaussing coils 27A to 27C. As a result, a problem of a mark generated on the fixed full-color image on the sheet P due to a mark generated on the surface of the fixing roller 20 because of the contact-type thermistor contacting the surface of the fixing roller 20 can be prevented.

In addition, because conventionally many components including the induction heating unit 25, the multiple spurs 42, and the separation plate 43 are densely packed around the fixing roller 20, it is difficult to spare enough space for installing multiple temperature detectors around the fixing roller 20. To solve such a problem, according to the illustrative embodiments described herein the multiple thermistors 40A to 40D are provided around the pressing roller 30 where the number of components provided is relatively small, without limitation of installation space.

Further, according to illustrative embodiments, an amount of power supplied to each of the multiple pairs of the degaussing coils 27A, 27B, and 27C is controlled by determining an increase in temperature at the non-conveyance portion of the pressing roller 30 using the multiple thermistors 40A to 40D. Accordingly, an excessive increase in temperature in the non-conveyance portion of the fixing roller 20 (or the pressing roller 30) and a decrease in a temperature at an edge of the conveyance portion of the fixing roller 20 (or the pressing roller 30) due to failure to properly detect an increase in temperature in the non-conveyance portion of the fixing roller 20 (or the pressing roller 30) can be prevented.

It is to be noted that, in place of the thermistors 40A to 40D, a contactless temperature detector such as a thermopile may be used as the temperature detector to detect a temperature distribution on the surface of the pressing roller 30.

As illustrated in FIG. 4B, the three pairs of the degaussing coils 27A, 27B, and 27C are positioned at least at two different heights to vary a distance between the exciting coil 26 and each of the pairs of the degaussing coils 27A, 27B, and 27C. Specifically, in order to differentiate the distance between the exciting coil 26 and each of the pairs of the degaussing coils 27A, 27B, and 27C provided next to each other, two different heights are set such that the pairs of the degaussing coils 27A, 27B, and 27C are positioned alternately at the two different heights. More specifically, the second pair of the degaussing coils 27B is positioned at a height closer to the exciting coil 26, and the first and third pairs of the degaussing coils 27A and 27C, both provided next to the second pair of the degaussing coils 27B, respectively, are positioned at a height farther from the exciting coil 26.

The distance between the second pair of the degaussing coils 27B and the exciting coil 26 is set to about 2 mm, and the distance between the exciting coil 26 and each of the first and third pairs of the degaussing coils 27A and 27C is set to about 5 mm.

Further, the three pairs of the degaussing coils 27A, 27B, and 27C are provided such that adjacent pairs of the degaussing coils 27A, 27B, and 27C partially overlap. Specifically, referring to FIG. 4A, an inner portion of a loop of the first pair of the degaussing coils 27A, that is, a center portion of the first pair of the degaussing coils 27A in a width direction of the induction heating unit 25, is superimposed on an outer portion of a loop of the second pair of the degaussing coils 27B, that is, an edge-side portion of the second pair of the degaussing coils 27B in a width direction of the induction heating unit 25, in a direction perpendicular to a plane surface of FIG. 4A. Similarly, an outer portion of a loop of the third pair of the degaussing coils 27C, that is, an edge-side portion of the third pair of the degaussing coils 27C in a width direction of the induction heating unit 25, is superimposed on an inner portion of the loop of the second pair of the degaussing coils 27B, that is, a center portion of the second pair of the degaussing coils 27B in the width direction of the induction heating unit 25.

The above-described configuration can prevent an increase in a size of the induction heating unit 25 in a height direction thereof, that is, the direction perpendicular to the plane surface of FIG. 4A, and a decrease in degaussing performance of the multiple pairs of the degaussing coils 27A, 27B, and 27C at a boundary between adjacent pairs of the degaussing coils 27A, 27B, and 27C. Further, the overlapping configuration of adjacent pairs of the degaussing coils 27A, 27B, and 27C reduces an interval between each of the multiple center cores 28 provided within the loop of each of the multiple pairs of the degaussing coils 27A, 27B, and 27C provided next to each other where no center core 28 is provided, thus equalizing the temperature distribution on the surface of the fixing roller 20 in the width direction thereof.

Each of the multiple center cores 28, the multiple arch cores 29, and the two side cores 35 includes a ferromagnetic body having a relative magnetic permeability of about 2,500, such as ferrite, and controls flux paths in which magnetic fluxes are formed generated by the exciting coil 26 or the multiple pairs of the degaussing coils 27A, 27B, and 27C, so that efficient magnetic fluxes to be applied to the heating layer in the sleeve layer 21 of the fixing roller 20 can be formed.

The coil guide 36 includes a resin material having higher thermal resistance and so forth, and supports the exciting coil 26 and the multiple pairs of the degaussing coils 27A, 27B, and 27C at a position opposite the fixing roller 20.

Referring to FIG. 4A, portions of the three pairs of the degaussing coils 27A, 27B, and 27C adjacent to each other are tilted relative to the width direction of the induction heating unit 25, such that each of the multiple center cores 28 provided within the loop of each of the three pairs of the degaussing coils 27A, 27B, and 27C partially overlaps the others when viewed from a direction perpendicular to the width direction of the induction heating unit 25, that is, a crosswise direction in FIG. 4A. Specifically, as illustrated in FIG. 4A, each of the first pair of the degaussing coils 27A and the center cores 28 provided within the loop of the pair of the first pair of the degaussing coils 27A is shaped in substantially a triangle when viewed from above. In addition, each of the second and third pairs of the degaussing coils 27B and 27C and the center cores 28 provided within the loop of each of the second and third pair of the degaussing coils 27B and 27C is shaped in substantially a parallelogram when viewed from above.

As described above, the adjacent multiple center cores 28 partially overlap the others when viewed from the direction perpendicular to the width direction of the induction heating unit 25. Accordingly, even when there is a space between each of the multiple center cores 28 provided within the loop of each of the pairs of the degaussing coils 27A, 27B, and 27C adjacent to each other, the multiple center cores 28 efficiently and evenly control the magnetic paths in the width direction of the induction heating unit 25. As a result, the three pairs of the degaussing coils 27A, 27B, and 27C further evenly degauss the magnetic fluxes generated by the exciting coil 26 in the width direction of the induction heating unit 25, and the temperature distribution in the conveyance portion on the surface of the fixing roller 20 is further equalized in the width direction thereof.

The fixing device 19 having the above-described configuration operates as described below during normal image forming processes.

When the fixing roller 20 is rotated in a counterclockwise direction in FIG. 2 by a drive motor, not shown, the pressing roller 30 is rotated in a clockwise direction in FIG. 2 along with rotation of the fixing roller 20. The heating layer in the sleeve layer 21 of the fixing roller 20 is heated at a position opposite the induction heating unit 25 by the magnetic fluxes generated by the exciting coil 26 of the induction heating unit 25.

Specifically, when a high-frequency alternating current of from 10 kHz to 1 MHz, preferably from 20 kHz to 800 kHz, flows to the exciting coil 26 from a power supply, not shown, in which a frequency of an oscillator circuit is variable, magnetic lines of force alternately switching bi-directionally are formed toward the sleeve layer 21 of the fixing roller 20 from the exciting coil 26. Formation of such an alternating magnetic field generates an eddy current in the heating layer in the sleeve layer 21 and Joule heat is generated in the heating layer by electrical resistance of the heating layer to inductively heat the heating layer. Accordingly, the sleeve layer 21 of the fixing roller 20 is heated by induction heating of the heating layer itself.

Thereafter, the surface of the fixing roller 20 heated by the induction heating unit 25 reaches the fixing nip formed between the fixing roller 20 and the pressing roller 30. At the fixing nip, a toner image T on the sheet P conveyed to the fixing nip is heated and melted.

Specifically, after the image forming processes described above are performed on the sheet P, the sheet P having the toner image T thereon is guided by the entrance guide plate 41 or the multiple spurs 42 and conveyed to the fixing nip formed between the fixing roller 20 and the pressing roller 30 in a direction of conveyance indicated by an arrow Y1 in FIG. 2. At the fixing nip, the toner image T is fixed to the sheet P by heat applied from the fixing roller 20 and pressure applied from the pressing roller 30. Thereafter, the sheet P having the fixed toner image T thereon is discharged from the fixing nip in a direction of conveyance indicated by an arrow Y2 in FIG. 2.

The surface of the fixing roller 20 passing through the fixing nip reaches the induction heating unit 25 again.

A series of processes described above is repeatedly performed, and fixing of the toner image T on the sheet P in the image forming processes is completed.

The configuration and operation of the fixing device 19 according to illustrative embodiments are described in greater detail below.

As described above, according to illustrative embodiments, an amount of power supplied to each of the three pairs of the degaussing coils 27A, 27B, and 27C is controlled based on the results detected by the multiple thermistors 40A to 40D each detecting a temperature on the surface of the pressing roller 30.

Figure 5:
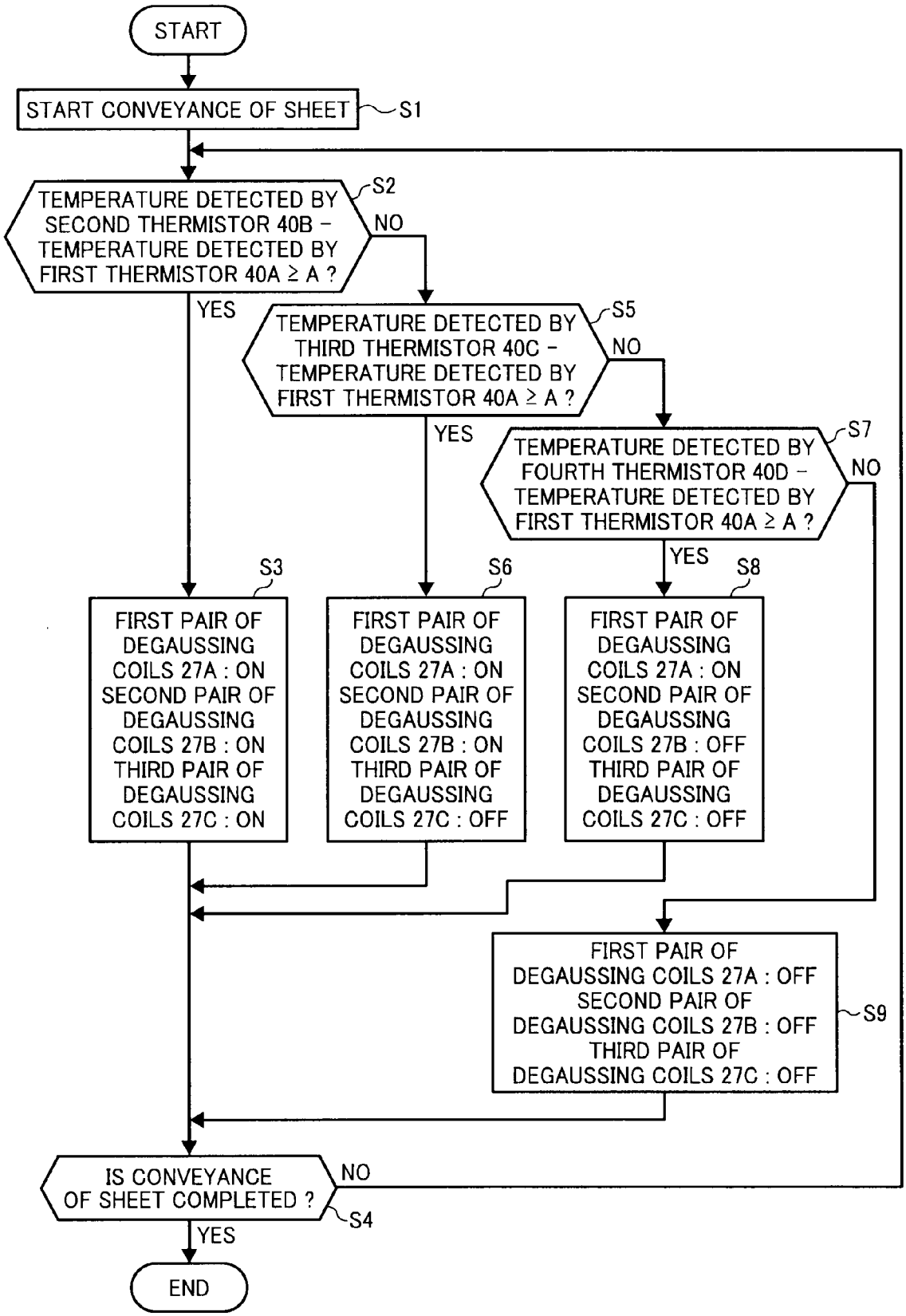
FIG. 5 is a flowchart illustrating processes to control power supply to each of the pairs of the degaussing coils based on results detected by the thermistors.

FIG. 5 is a flowchart illustrating processes to control power supply to each of the three pairs of the degaussing coils 27A, 27B, and 27C based on the results detected by the multiple thermistors 40A to 40D.

Referring to FIG. 5, at S1, conveyance of the sheet P to the fixing nip is started. After a predetermined period of time elapses, at S2, it is determined whether or not a difference between a temperature detected by the second thermistor 40B serving as the second temperature detector unit to detect a temperature at a position on the surface of the pressing roller 30 in the width direction thereof corresponding to the third pair of the degaussing coils 27C, and a temperature detected by the first thermistor 40A serving as the first temperature detector unit to detect a temperature at the center on the surface of the pressing roller 30 in the width direction thereof is a predetermined value A or greater. In illustrative embodiments, the predetermined value A is set to 10° C.

Figure 6:
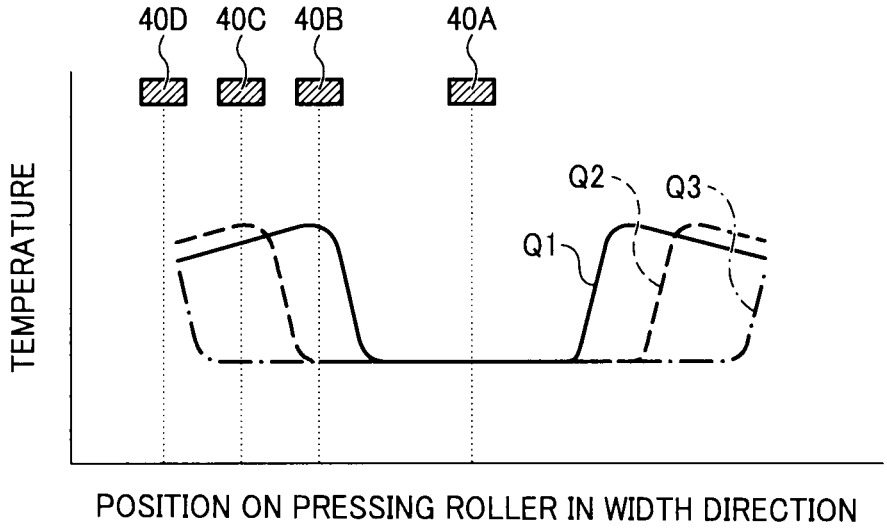
FIG. 6 is a graph illustrating a temperature distribution on a surface of a pressing roller in a width direction thereof.

When it is determined that the temperature detected by the second thermistor 40B is greater than the temperature detected by the first thermistor 40A by the predetermined value A or more (YES at S2), it is assumed that the temperature distribution on the surface of the pressing roller 30 in the width direction thereof is like that indicated by a solid line Q1 in a graph illustrated in FIG. 6, and the process proceeds to S3 to start power supply to all three pairs of the degaussing coils 27A, 27B, and 27C. In other words, it is determined that the sheet P having the postcard size is consecutively conveyed to the fixing nip, and all three pairs of the degaussing coils 27A, 27B, and 27C provided within the non-conveyance portion of the pressing roller 30 are driven to degauss the magnetic flues generated by the exciting coil 26 to prevent an excessive increase in the temperature at the non-conveyance portion of the fixing roller 20. Thereafter, at S4, it is determined whether or not consecutive conveyance of the sheet P is completed. When completion of consecutive conveyance of the sheet P is confirmed (YES at S4), this control sequence for the three pairs of the degaussing coils 27A, 27B, and 27C is completed.

When it is determined that a difference between the temperature detected by the second thermistor 40B and the temperature detected by the first thermistor 40A is smaller than the predetermined value A (NO at S2), it is preferable not to supply power to the third pair of the degaussing coils 27C. Specifically, power supply to the third pair of the degaussing coils 27C provided closest to both edges of the sheet P in the width direction thereof consecutively conveyed to the fixing nip is controlled to reduce a difference in a temperature between the center on the surface of the fixing roller 20, that is, the conveyance portion of the fixing roller 20, and the non-conveyance portion of the fixing roller 20. In other words, a temperature at the position on the surface of the pressing roller 30 in the width direction thereof corresponding to the third pair of the degaussing coils 27C is controlled to approach a target temperature as well as the temperature at the center on the surface of the pressing roller 30 in the width direction thereof. Accordingly, even when a portion of the position on the surface of the pressing roller 30 in the width direction thereof corresponding to the third pair of the degaussing coils 27C belongs to the conveyance portion of the pressing roller 30, a temperature at that portion does not become considerably lower than the target temperate for the conveyance portion, and is controlled to approach the target temperature in the same way as the temperature at the center on the surface of the pressing roller 30 in the width direction thereof. As a result, both edges of the toner image T in the width direction of the sheet P can be reliably fixed to the sheet P.

Alternatively, power supply to the third pair of the degaussing coils 27C may be controlled such that the temperature detected by the second thermistor 40B approaches a predetermined target temperature, for example, 180° C. Specifically, when the temperature detected by the second thermistor 40B is equal to or greater than the predetermined target temperature, a duty cycle of the third pair of the degaussing coils 27C is controlled to be 100%. By contrast, when the temperature detected by the second thermistor 40B is lower than the predetermined target temperature, a duty cycle of the third pair of the degaussing coils 27C is controlled to be 0%.

When it is determined that a difference between the temperature detected by the second thermistor 40B and the temperature detected by the first thermistor 40A is smaller than the predetermined value A (NO at S2), the process proceeds to S5. At S5, it is determined whether or not a difference between a temperature detected by the third thermistor 40C serving as the second temperature detector unit to detect a temperature at a position on the surface of the pressing roller 30 in the width direction thereof corresponding to the second pair of the degaussing coils 27B, and the temperature detected by the first thermistor 40A is equal to or greater than the predetermined value A. It is to be noted that, as described above, the predetermined value A is set to 10° C. according to illustrative embodiments.

When it is determined that the temperature detected by the third thermistor 40C is greater than the temperature detected by the first thermistor 40A by the predetermined value A or more (YES at S5), it is assumed that the temperature distribution on the surface of the pressing roller 30 in the width direction thereof is like that indicated by a broken line Q2 in the graph illustrated in FIG. 6, and the process proceeds to S6 to start power supply to the first and second pairs of the degaussing coils 27A and 27B, respectively. In other words, it is determined that the sheet P having either the A4 size (portrait orientation) or the B5 size (portrait orientation) is consecutively conveyed to the fixing nip, and the first and second pairs of the degaussing coils 27A and 27B provided within the non-conveyance portion of the fixing roller 20 are driven to degauss the magnetic fluxes generated by the exciting coil 26 to prevent an excessive increase in the temperature in the non-conveyance portion of the fixing roller 20.

Thereafter, the process proceeds to S4 to determine whether or not consecutive conveyance of the sheet P is completed. When completion of consecutive conveyance of the sheet P is confirmed (YES at S4), this control sequence for the pairs of the degaussing coils 27A, 27B, and 27C is completed.

When it is determined that a difference between the temperature detected by the third thermistor 40C and the temperature detected by the first thermistor 40A is smaller than the predetermined value A (NO at S5), it is preferable not to supply power to the second pair of the degaussing coils 27B. Specifically, power supply to the second pair of the degaussing coils 27C provided closest to both edges of the sheet P in the width direction thereof consecutively conveyed to the fixing nip is controlled to reduce a difference in a temperature between the center on the surface of the fixing roller 20, that is, the conveyance portion of the fixing roller 20, and the temperature in the non-conveyance portion of the fixing roller 20. Accordingly, even when a portion on the position on the surface of the pressing roller 30 in the width direction thereof corresponding to the second pair of the degaussing coils 27B belongs to the conveyance portion of the pressing roller 30, a temperature at that portion does not become considerably lower than the target temperate for the conveyance portion, and is controlled to approach the target temperature in the same way as the temperature at the center on the surface of the pressing roller 30 in the width direction thereof. As a result, both edges of the toner image T in the width direction of the sheet P can be reliably fixed to the sheet P.

When it is determined that a difference between the temperature detected by the third thermistor 40C and the temperature detected by the first thermistor 40A is smaller than the predetermined value A (NO at S5), the process proceeds to S7. At S7, it is determined whether or not a difference between a temperature detected by the fourth thermistor 40D serving as the second temperature detector unit to detect a temperature at a position on the surface of the pressing roller 30 in the width direction thereof corresponding to the first pair of the degaussing coils 27A and the temperature detected by the first thermistor 40A is equal to or greater than the predetermined value A. It is to be noted that, as described above, the predetermined value A is set to 10° C. according to illustrative embodiments.

When it is determined that the temperature detected by the fourth thermistor 40D is greater than the temperature detected by the first thermistor 40A by the predetermined value A or more (YES at S7), it is assumed that the temperature distribution on the surface of the pressing roller 30 in the width direction thereof is like that indicated by a dot-dashed line Q3 in the graph illustrated in FIG. 6, and the process proceeds to S8 to start power supply to only the first pair of the degaussing coils 27A. In other words, it is determined that the sheet P having the B4 size (portrait orientation) is consecutively conveyed to the fixing nip, and the first pair of the degaussing coils 27A provided within the non-conveyance portion of the fixing roller 20 is driven to degauss the magnetic fluxes generated by the exciting coil 26 to prevent an excessive increase in the temperature in the non-conveyance portion of the fixing roller 20.

Thereafter, the process proceeds to S4 to determine whether or not consecutive conveyance of the sheet P is completed. When completion of consecutive conveyance of the sheet P is confirmed (YES at S4), this control sequence for the pairs of the degaussing coils 27A, 27B, and 27C is completed.

When it is determined that a difference between the temperature detected by the fourth thermistor 40D and the temperature detected by the first thermistor 40A is smaller than the predetermined value A (NO at S7), it is preferable not to supply power to the first pair of the degaussing coils 27A. Specifically, power supply to the first pair of the degaussing coils 27A provided closest to both edges of the sheet P in the width direction thereof consecutively conveyed to the fixing nip is controlled to reduce a difference in a temperature between the center on the surface of the fixing roller 20 in the width direction thereof, that is, the conveyance portion of the fixing roller 20, and the non-conveyance portion of the fixing roller 20. Accordingly, even when a portion of the position on the surface of the pressing roller 30 in the width direction thereof corresponding to the first pair of the degaussing coils 27A belongs to the conveyance portion of the pressing roller 30, a temperature at that portion does not become considerably lower than the target temperate for the conveyance portion, and is controlled to approach the target temperature in the same way as the temperature at the center on the surface of the pressing roller 30 in the width direction thereof. As a result, both edges of the toner image T in the width direction of the sheet P can be reliably fixed to the sheet P.

When it is determined that a difference between the temperature detected by the fourth thermistor 40D and the temperature detected by the first thermistor 40A is smaller than the predetermined value A (NO at S7), it is assumed that the temperature distribution on the surface of the pressing roller 30 is substantially even in the width direction thereof, and the process proceeds to S9. At S9, power supply to all three pairs of the degaussing coils 27A, 27B, and 27C is stopped. Specifically, it is determined that the sheet P having the A3 size (portrait orientation) is consecutively conveyed to the fixing nip and almost all portions of the surface of the pressing roller 30 in the width direction thereof is the conveyance portion. In other words, it is determined that there is no excessive increase in temperature at the two edges of the sheet P, and degaussing operations are not performed by the pairs of the degaussing coils 27A, 27B, and 27C.

Thereafter, the process proceeds to S4 to determine whether or not consecutive conveyance of the sheet P to the fixing nip is completed. When completion of consecutive conveyance of the sheet P is confirmed (YES at S4), this control sequence for the pairs of the degaussing coils 27A, 27B, and 27C is completed.

It is to be noted that, preferably, power supply to each of the pairs of the degaussing coils 27A, 27B, and 27C is controlled by calculating an amount of power supplied to each of the pairs of the degaussing coils 27A, 27B, and 27C under proportional control, differential control, integral control, or a combination of two or more of proportional control, differential control, and integral control. As a result, temperature fluctuation is reduced compared to a case in which power supply to each of the pairs of the degaussing coils 27A, 27B, and 27C is turned on or off, so that the temperature in the non-conveyance portion of the pressing roller 30 reliably approaches the target temperature.

Specifically, when power supply to the third pair of the degaussing coils 27C is controlled by combining all of proportional control, differential control, and integral control at S2 in FIG. 5, a duty cycle D of the third pair of the degaussing coils 27C is calculated by a formula of Duty Cycle D (%)=Kp (M0−N)+Kd(M0−M1)+Ki·∫(M0−N)dt, where M0 is a present temperature detected by the second thermistor 40B, M1 is a past temperature detected at the last control frequency by the second thermistor 40B, and N is a target temperature for the surface of the pressing roller 30. It is to be noted that each of Kp, Kd, and Ki in the above-described formula is a parameter value, and is set to 100, 10, and 10, respectively, according to illustrative embodiments. Further, the target temperature N is set to 180° C. according to illustrative embodiments.

When a predetermined number of the sheet P or more is consecutively conveyed to the fixing nip, it is preferable that control of power supply to each of the pairs of the degaussing coils 27A, 27B, and 27C is started a predetermined period of time after the start of consecutive conveyance of the sheet P, and is stopped when consecutive conveyance of the sheet P is completed.

Specifically, when a control unit of the image forming apparatus 1 receives an instruction to consecutively convey a predetermined number of the sheet P or more to the fixing nip, control of power supply to each of the pairs of the degaussing coils 27A, 27B, and 27C is started the predetermined period of time after the start of the consecutive conveyance of the sheet P to the fixing nip. Thereafter, when the control unit of the image forming apparatus 1 receives a signal indicating a completion of consecutive conveyance of the sheet P, control of power supply to each of the pairs of the degaussing coils 27A, 27B, and 27C is stopped.

As a result, slow startup of the fixing roller 20 and the pressing roller 30 due to control of power supply to each of the pairs of the degaussing coils 27A, 27B, and 27C performed while the sheet P is not conveyed to the fixing nip, such as during a warm-up period and a waiting mode, can be prevented. Further, control of power supply to each of the pairs of the degaussing coils 27A, 27B, and 27C is not performed unless an excessive increase in temperature at the non-conveyance portion occurs.

As described above, according to illustrative embodiments, power supply to each of the pairs of the degaussing coils 27A, 27B, and 27C is controlled based on the results detected by each of the multiple thermistors 40A to 40D that detect the surface temperature of the pressing roller 30 at multiple positions in a width direction thereof. Accordingly, a higher degree of flexibility can be achieved in types and installation positions of the thermistors 40A to 40D, and an excessive increase in temperature at the non-conveyance portion of the fixing roller 20 can be efficiently and reliably prevented by the pairs of the degaussing coils 27A, 27B, and 27C.

Although applied to the fixing device 19 including the fixing roller 20 serving as a fixing member and the pressing roller 30 serving as a pressing member, the foregoing illustrative embodiments are also applicable to an electromagnetic induction heating fixing device including a fixing belt or a fixing film serving as a fixing member, and a pressing belt or a pressing pad serving as a pressing member.

Further, although applied to the fixing device 19 including the fixing roller 20 serving as a heating member inductively heated by the induction heating unit 25, the foregoing illustrative embodiments are also applicable to a fixing device including a heating member serving as a heat generator to heat a fixing member. For example, the foregoing illustrative embodiments are applicable to a fixing device that indirectly heats a fixing belt serving as a fixing member stretched by a heating roller serving as a heat generator including a heating layer by inductively heating the heating roller using an induction heating unit. The same effects as those obtained by the foregoing illustrative embodiments can be achieved.

Although applied to the fixing device 19 including the three pairs of the degaussing coils 27A, 27B, and 27C, the foregoing illustrative embodiments are applicable to a fixing device including only a single pair of degaussing coils. Alternatively, a number of a pair of degaussing coils may be two, four, or more, achieving the same effects as those obtained by the foregoing illustrative embodiments.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A fixing device, comprising:

a fixing member to melt a toner image to fix the toner image to a recording medium;

a pressing member pressed against the fixing member to form a nip to where the recording medium is conveyed;

a fixing member temperature detector provided to detect the temperature of the fixing member;

multiple pressing member temperature detectors provided to detect a temperature at multiple positions in a width direction of the pressing member in a width direction thereof;

a heating member comprising a heating layer to heat the fixing member, wherein an amount of power supplied to the heating member is controlled based on a result detected by the fixing member temperature detector;

an exciting coil provided opposite the heating member to generate magnetic fluxes to inductively heat the heating layer using the magnetic fluxes; and one or more pairs of degaussing coils provided opposite the exciting coil at both edges of the fixing member in a width direction thereof to generate magnetic fluxes at both edges of the fixing member to degauss the magnetic fluxes generated by the exciting coil, wherein an amount of power supplied to the one or more pairs of degaussing coils is controlled based on a result detected by each of the multiple pressing member temperature detectors.

2. The fixing device according to claim 1, wherein the multiple pressing member temperature detectors comprise:

a first temperature detector unit to detect a temperature at a center on the surface of the pressing member in the width direction thereof; and one or more second temperature detector units to detect a temperature at an edge on the surface of the pressing member in the width direction thereof corresponding to a position of at least a counterpart of the one or more pairs of degaussing coils.

3. The fixing device according to claim 2, wherein when a difference between a temperature detected by the first temperature detector unit and a temperature detected by the second temperature detector unit is equal to or greater than a predetermined value, power supply to the pair of the degaussing coils corresponding to the second temperature detector unit is started.

4. The fixing device according to claim 2, wherein when a difference in a temperature detected by the first temperature detector unit and a temperature detected by the second temperature detector unit is smaller than a predetermined value, power supply to the pair of the degaussing coils corresponding to the second temperature detector unit is not performed.

5. The fixing device according to claim 1, wherein an amount of power supplied to the one or more pairs of degaussing coils is calculated under one of proportional control, differential control, integral control, and a combination of two or more of proportional control, differential control, and integral control to control the one or more pairs of degaussing coils.

6. The fixing device according to claim 1, further comprising a switching circuit to turn on and off power supply to the one or more pairs of degaussing coils, wherein a proportion of time to turn on and off power supply to the one or more pairs of degaussing coils for a predetermined frequency is varied by the switching circuit to control an amount of power supplied to the one or more pairs of degaussing coils.

7. The fixing device according to claim 1, wherein when a predetermined number of the recording medium or more is consecutively conveyed to the nip, control of power supply to the one or more pairs of degaussing coils is started a predetermined period of time after the start of consecutive conveyance of the recording medium, and is stopped when consecutive conveyance of the recording medium is completed.

8. The fixing device according to claim 1, wherein the one or more pairs of degaussing coils are deployed so as to vary a portion of the heating layer to be heated in the width direction of the fixing member depending on a conveyance portion of the fixing member covered by each of multiple types of the recording medium having a different size.

9. The fixing device according to claim 1, wherein the heating member is the fixing member.

10. The fixing device according to claim 1, wherein the heating member heats the fixing member.

11. An image forming apparatus comprising a fixing device, the fixing device comprising:

a fixing member to melt a toner image to fix the toner image to a recording medium;

a pressing member pressed against the fixing member to form a nip to where the recording medium is conveyed;

a fixing member temperature detector provided to detect the temperature of the fixing member;

multiple pressing member temperature detectors provided to detect a temperature at multiple positions in a width direction of the pressing member in a width direction thereof;

a heating member comprising a heating layer to heat the fixing member, wherein an amount of power supplied to the heating member is controlled based on a result detected by the fixing member temperature detector;

an exciting coil provided opposite the heating member to generate magnetic fluxes to inductively heat the heating layer using the magnetic fluxes; and one or more pairs of degaussing coils provided opposite the exciting coil at both edges of the fixing member in a width direction thereof to generate magnetic fluxes at both edges of the fixing member to degauss the magnetic fluxes generated by the exciting coil, wherein an amount of power supplied to the one or more pairs of degaussing coils is controlled based on a result detected by each of the multiple pressing member temperature detectors.

12. The image forming apparatus according to claim 11, wherein the multiple pressing member temperature detectors comprise:

a first temperature detector unit to detect a temperature at a center on the surface of the pressing member in the width direction thereof; and one or more second temperature detector units to detect a temperature at an edge on the surface of the pressing member in the width direction thereof corresponding to a position of at least a counterpart of the one or more pairs of degaussing coils.

13. The image forming according to claim 12, wherein when a difference between a temperature detected by the first temperature detector unit and a temperature detected by the second temperature detector unit is equal to or greater than a predetermined value, power supply to the pair of the degaussing coils corresponding to the second temperature detector unit is started.

14. The image forming apparatus according to claim 12, wherein when a difference in a temperature detected by the first temperature detector unit and a temperature detected by the second temperature detector unit is smaller than a predetermined value, power supply to the pair of the degaussing coils corresponding to the second temperature detector unit is not performed.

15. The image forming apparatus according to claim 11, further comprising a switching circuit to turn on and off power supply to the one or more pairs of degaussing coils, wherein a proportion of time to turn on and off power supply to the one or more pairs of degaussing coils for a predetermined frequency is varied by the switching circuit to control an amount of power supplied to the one or more pairs of degaussing coils.

16. The image forming apparatus according to claim 11, wherein when a predetermined number of the recording medium or more is consecutively conveyed to the nip, control of power supply to the one or more pairs of degaussing coils is started a predetermined period of time after the start of consecutive conveyance of the recording medium, and is stopped when consecutive conveyance of the recording medium is completed.

17. The image forming apparatus according to claim 11, wherein the one or more pairs of degaussing coils are deployed so as to vary a portion of the heating layer to be heated in the width direction of the fixing member depending on a conveyance portion of the fixing member covered by each of multiple types of the recording medium having a different size.

18. The image forming apparatus according to claim 11, wherein the heating member is the fixing member.

19. The image forming apparatus according to claim 11, wherein the heating member heats the fixing member.

20. A fixing method, comprising the steps of:

melting a toner image to fix the toner image to a recording medium;

forming a nip between a fixing member and a pressing member to where the recording medium is conveyed;

detecting the temperature of the fixing member;

detecting a temperature at multiple positions on a surface of the pressing member in a width direction thereof using multiple temperature detectors;

heating a heating member to heat the fixing member;

generating first magnetic fluxes to inductively heat the heating member based on the detected temperature of the fixing member; and generating second magnetic fluxes at both edges of the fixing member to degauss the first magnetic fluxes, wherein an amount of power supplied for generating the second magnetic fluxes at both edges of the fixing member is controlled based on detection readings provided by the multiple temperature detectors.

21. The fixing device according to claim 1, wherein the fixing member temperature detector detects the temperature at a central portion in a width direction of the fixing member.

22. The image forming apparatus according to claim 11, wherein the fixing member temperature detector detects the temperature at a central portion in a width direction of the fixing member.

23. The fixing method according to claim 20, wherein the temperature of the fixing member is detected at a central portion in a width direction of the fixing member.

* * * * *